United States Patent [19]

Sanborn

[11] Patent Number: 4,747,246

[45] Date of Patent: May 31, 1988

[54] SUSPENDED CEILING STRUCTURE

[76] Inventor: James V. Sanborn, 214 SW. 21st Ter., Ft. Lauderdale, Fla. 33301

[21] Appl. No.: 22,995

[22] Filed: Mar. 6, 1987

[51] Int. Cl.[4] ..... E04C 2/38

[52] U.S. Cl. ..... 52/311; 52/313; 52/484; 52/717.1; 52/DIG. 8; 52/DIG. 4

[58] Field of Search ..... 52/311–316, 52/717–718, 716, 484, DIG. 8, 489, DIG. 4

[56] References Cited

U.S. PATENT DOCUMENTS

| | | | |
|---|---|---|---|
| 985,367 | 2/1911 | Pitney | 52/DIG. 8 |
| 3,583,119 | 6/1971 | Kann | 52/311 |
| 3,594,972 | 7/1971 | Jones | 52/311 X |
| 3,843,475 | 10/1974 | Kent | 52/312 X |
| 3,890,415 | 6/1975 | Hull | 52/DIG. 8 |
| 3,936,990 | 2/1976 | Garrison, Jr. | 52/717 |
| 4,055,930 | 11/1977 | Weinar et al. | 52/717 |
| 4,189,888 | 2/1980 | Blitzer | 52/484 |
| 4,452,021 | 6/1984 | Anderson | 52/311 |
| 4,541,215 | 9/1985 | Nickloy et al. | 52/DIG. 8 |
| 4,569,175 | 2/1986 | Abciuk | 52/312 X |

*Primary Examiner*—David A. Scherbel
*Assistant Examiner*—Richard E. Chilcot, Jr.

[57] ABSTRACT

Disclosed is a suspended ceiling having rectilinear panels held within a co-planar matrix of inverted T-grid elements; each T-grid element possesses a horizontal and a vertical component.

The T-grid elements are suspended by their vertical component from the natural ceiling or ceiling beams. The improvement set forth relates the use of imitation beams secureable to the horizontal components of the matrix of T-grid elements at a time after installation of the suspended ceiling has occurred. Each of the imitation beams is an elongate rectilinear element complemental on at least one surface with the horizontal component of the T-grid elements. Included are press-fit securement elements in the rectilinear elements, such elements imbedded within the complemental surface of the elongate elements. Thereby an imitation beam structure for a suspended ceiling may be achieved through the manual affixation of the rectilinear elements to the horizontal components of the matrix of the T-grid elements. Each of the rectilinear elements is provided with a woodgrain or other pleasing-to-the-eye surface ornamentation such that, from the perspective of an occupant of a room covered by a suspended ceiling, a favorable impression of depth and richness is imparted.

2 Claims, 1 Drawing Sheet

SUSPENDED CEILING STRUCTURE

BACKGROUND OF THE INVENTION

The present invention relates to an improved method and means for the attachment of a false beam structure to a suspended ceiling.

Suspended ceilings have been well known in the art for a period of more than thirty years. In most newer construction, particularly, commercial construction, it is most common to employ a suspended ceiling such that various venting, heating, air conditioning, electrical, telephone, and other wiring and duct work, may be located between the suspended ceiling and the natural ceiling of the structure.

In the construction of suspended ceilings, the use of an inverted T-grid element has become common. The T-grid element is suspended from its vertical component from the natural ceiling of the building structure. The T-grid element, when inverted, also has horizontal components which are in the nature of longitudinal flanges, extending in a co-planar fashion and at right angles to the plane of the said vertical component of the T-grid element.

After a suitable matrix of said T-grid elements has been suspended from the natural ceiling, at an appropriate distance therefrom, a multiplicity of rectilinear panels are positioned on the flanges of the horizontal components of the T-grid elements. The result of this is the rather familiar grid-like pattern of ceiling panels that characterize essentially all suspended ceilings.

In order to enhance the esthetic appeal of such grid patterns of suspended ceilings, certain steps have been suggested. In the first instance, the outer or downward facing component of each inverted T-grid element may be colored to provide a suitable contrast or complement to the colors of the panels held between the T-grid elements. Also the prior art indicates that a broad variety of ornamental designs of the panels (which also serve an acoustical function) can be achieved.

The present invention may be viewed as an effort to enhance the aesthetic appeal and diversity of dropped ceilings by providing a means and method by which a false beam structure may be conveniently attached to the horizontal component of the T-grid elements of the suspended ceiling at a time after the suspended ceiling has been installed.

The prior art, as best known to the inventor, is represented by U.S. Pat. No. 776,344 (1904) to Nielson; No. 985,367 (1911) to Pitney; No. 3,387,872 (1968) to Lovullo; and No. 4,541,215 (1985) to Nickloy.

The above prior art, as well as other art, relates only to the generalized use of false beams in interior construction. Therein, the false or imitation ceiling beams is attached by means of a clip attachment to a natural beam within the ceiling. Neither the above nor any other prior art discloses a means or method for the attachment of a false or imitation beam structure to a suspended ceiling; rather, the prior art is limited in its attention to the construction of false or imitation beams which attach directly to the natural ceiling structure. The teachings of such prior art are not applicable to the inventive means and method disclosed herein, and the advantages derived therefrom.

SUMMARY OF THE INVENTION

The present invention relates to a suspended ceiling having a multiplicity of rectilinear panels held within a coplanar matrix of inverted T-grid elements; each T-grid element possesses a horizontal and a vertical component.

The T-grid elements are suspended by their vertical component from the natural ceiling or ceiling beams. The improvement set forth herein relates the use of a multiplicity of imitation beams secureable to said horizontal components of said matrix of T-grid elements at a time after installation of the suspended ceiling has occurred. Each of said imitation beams comprises an elongate rectilinear element complemental on at least one surface with said horizontal component of said T-grid elements. Included are means for effecting a press-fit securement of said rectilinear elements to the horizontal components thereof, said means imbedded within said complemental surface of said elongate elements. Thereby an imitation beam structure for a suspended ceiling may be achieved through the manual affixation of said rectilinear elements to said horizontal components of said matrix of said T-grid elements. Each of said rectilinear elements is provided with a woodgrain or other pleasing-to-the-eye surface ornamentation such that, from the perspective of an occupant of a room covered by a suspended ceiling, a favorable impression of depth and richness is imparted.

It is accordingly an object of the present invention to provide a method and means for attaching imitation beams to an existing support structure of a suspended ceiling.

It is another object to provide a method and means for enhancing or modifying the esthetics of a dropped ceiling.

It is a further object to provide a method and means for modifying the appearance of a dropped ceiling structure which, if desired, may be removed from the dropped ceiling at a later time.

The above and yet other objects and advantages of the present invention will become apparent from the hereinafter set forth Detailed Description of the Invention, the Drawings, and claims appended herewith.

DETAILED DESCRIPTION OF THE INVENTION

Figure 1:
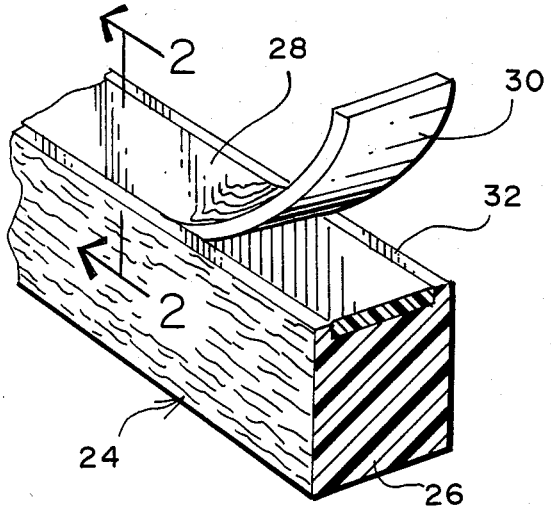
FIG. 1 is a front perspective view showing a rectilinear element and its associated press-fit means.

With reference to FIG. 1, there is shown an imitation beam 24 which comprises an elongate rectilinear element 26 having a complemental surface 28. Said complemental surface 28 is formed by the placement of a securement means 30 within a channel 32 of element 26. In one embodiment, securement means 30 may be a magnetic strip. In a second embodiment, securement means 30 may comprise a strip of hook and loop-pile fasteners; and in a third embodiment, strip 30 may comprise a strip of adhesive material which is normally covered or sealed from the air prior to its usage.

Figure 2:
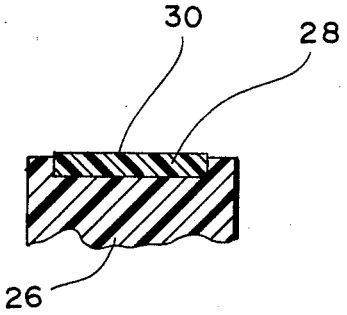
FIG. 2 is a cross-sectional, fragmentary view, along Line 2—2 of FIG. 1.

In the cross-sectional view of FIG. 2 may be seen the end product of rectilinear element 26 after securement means 30 has been imbedded thereinto to form complemental surface 28.

Figure 3:
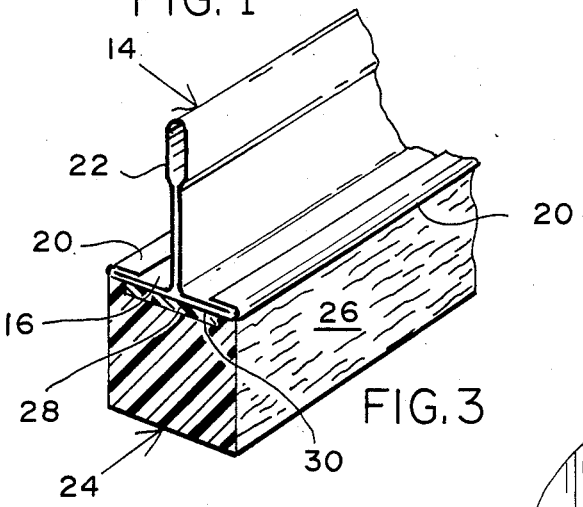
FIG. 3 is a perspective view showing an inverted T-grid element affixed to the elongate rectilinear element.

The relationship between imitation beam 24 and an inverted T-grid element 14 used in a suspended ceiling is shown in FIG. 3. More particularly, in FIG. 3 may be seen said T-grid element 14 which includes a horizontal component 16 and a vertical component 22. Said horizontal component 16 includes an outer (lower) surface 18 (see FIG. 4) and longitudinal flange elements 20. As may be noted in FIGS. 3 and 4, the geometry of complemental surface 28 of rectilinear element 26 is such that a flush engagement of securement means 30 against outer surface 18 of horizontal components 16 T-grid element 14 will occur, whether the mating between complemental surface 28 and outer surface 18 be the result of the use of magnetics, velcro, or an adhesive.

In the velcro embodiment, a mating strip of velcro would be provided to outer surface 18 of said horizontal component 16 of the T-grid element.

Figure 4:
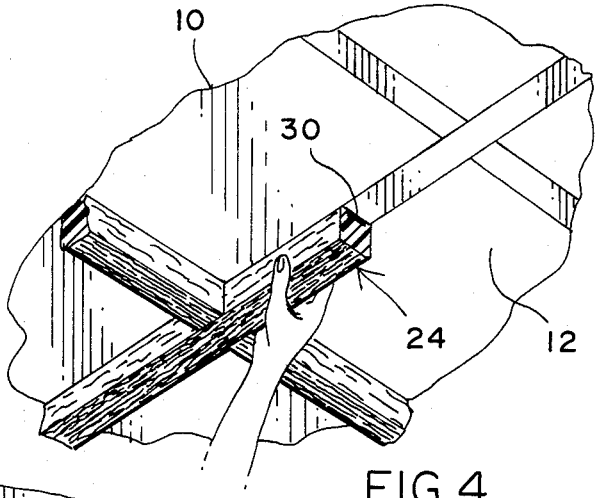
FIG. 4 is an operational view showing the manual affixing of a false beam to a horizontal component of a T-grid element of a suspended ceiling.

In the perspective view of FIG. 4 there is shown the manner in which imitation beams 24, made in accordance with this invention, may be readily placed onto said outer surface 18 of the T-grid elements without interference with rectilinear panel 12 of suspended ceiling 10. In the case of the magnetic and velcro embodiments, imitation beams 24 may, if desired, be removed from the T-grid elements at a later date.

Figure 5:
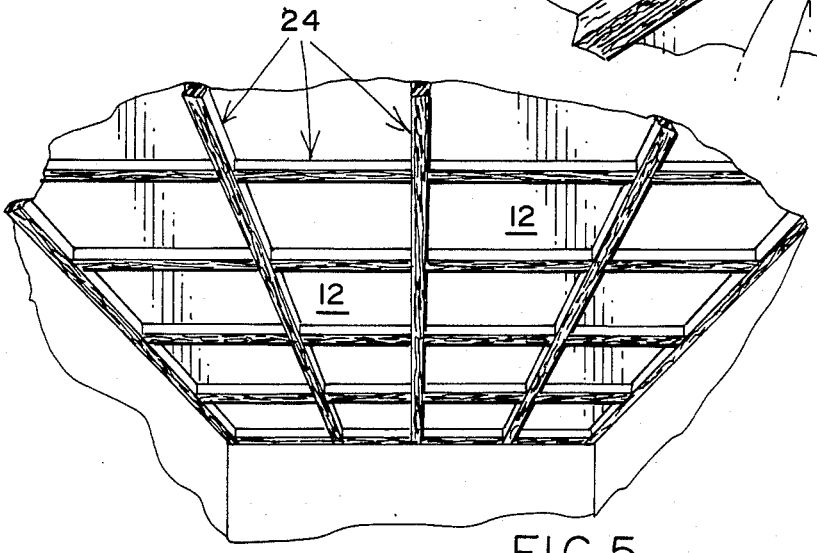
FIG. 5 is a perspective view showing the appearance of a suspended ceiling that has been provided with the present inventive imitation beam structure.

In FIG. 5 is shown the appearance which is achieved when a suspended ceiling is provided with the inventive false beam system.

As may be appreciated, the external surface and contour of imitation beam 24 may be subject to great variety. Accordingly, many interior decorating design effects may be achieved through the present inventive method and means.

The present inventive structure is commercially marketed under the trademark MAGNETIC GRID.

Accordingly, while there have been shown and described the preferred embodiment of the present invention, it will be understood that the invention may be embodied otherwise than as herein specifically illustrated or described and that within said embodiments certain changes in the detail and construction, and the form of arrangement of the parts may be made without departing from the underlying idea or principles of this invention within the scope of the appended claims.

Having thus described my invention, what I claim as new, useful and non-obvious and, accordingly, secure by Letters Patent of the United States is:

1. A suspended ceiling having a multiplicity of rectilinear panels held within a co-planar matrix of inverted T-grid elements having horizontal and vertical components, each vertical component suspended from a natural ceiling, the improvement comprising:

a plurality of imitation beams secureable to said horizontal component of said inverted T-grid elements after installation of said suspended ceiling has occurred, each of said imitation beams themselves comrising:

(a) an elongate rectilinear element complemental on at least one surface with said horizontal component of said T-grid elements, said one surface of said horizontal component comprising a ferromagnetic material; and (b) means for effecting a press-fit securement of said elongate element to said horizontal component of said T-grid element, said press-fit means imbedded within said complemental surface of said elongate rectilinear element said press-fit means comprising a permanent magnet, whereby an imitation beam structure for a suspended ceiling may be achieved through the affixation of said rectilinear elements to said horizontal components of said matrix of inverted T-grid elements.

2. A method for providing a suspended ceiling having a multiplicity of rectilinear panels within a co-planar matrix of inverted T-grid elements, said elements having horizontal and vertical components, said vertical components suspended from the natural ceiling, with a multiplicity of imitation beams, the method comprising the steps of:

(a) providing a plurality of elongate rectilinear elements complemental on at least one surface with said horizontal components of said inverted T-grid elements said one surface of said horizontal components comprising a ferro-magnetic material;

(b) providing said complemental surface of each of said elongate rectilinear elements with means for effecting a press-fit securement of said elongate elements, said means for effecting a press-fit comprising a permanent magnet to said horizontal component of said T-grid elements; and (c) manually pressing said elongate elements onto said horizontal components, whereby an imitation beam structure may be achieved through the affixation of said rectilinear elements to said horizontal components of said matrix of T-grid elements.

* * * * *